US010006399B2

(12) United States Patent
Scherer et al.

(10) Patent No.: US 10,006,399 B2
(45) Date of Patent: Jun. 26, 2018

(54) CYLINDER SLEEVE WITH WEAR-RESISTANT INNER LAYER

(71) Applicant: Federal-Mogul Burscheid GmbH, Burscheid (DE)

(72) Inventors: Volker Scherer, Cologne (DE); Jurgen Gillen, Leverkusen (DE); Nigel Gray, Bergisch Gladbach (DE)

(73) Assignee: Federal-Mogul Burscheid GmbH, Burscheid (DE)

( * ) Notice: Subject to any disclaimer, the term of this patent is extended or adjusted under 35 U.S.C. 154(b) by 646 days.

(21) Appl. No.: 14/428,867

(22) PCT Filed: Jul. 15, 2013

(86) PCT No.: PCT/EP2013/064875
§ 371 (c)(1),
(2) Date: Mar. 17, 2015

(87) PCT Pub. No.: WO2014/040775
PCT Pub. Date: Mar. 20, 2014

(65) Prior Publication Data

US 2015/0240741 A1 Aug. 27, 2015

(30) Foreign Application Priority Data

Sep. 17, 2012 (DE) ..... 10 2012 216 518

(51) Int. Cl.
*F02F 1/00* (2006.01)
*C23C 4/08* (2016.01)
*C23C 4/18* (2006.01)

(52) U.S. Cl.
CPC ..... *F02F 1/004* (2013.01); *C23C 4/08* (2013.01); *C23C 4/18* (2013.01); *F02F 2001/008* (2013.01)

(58) Field of Classification Search
CPC ..... F02F 1/00; F02F 1/10; F02F 1/004; F02F 2001/008; F02F 1/16; F02F 11/005; C23C 4/18; C23C 4/08
USPC ..... 123/193.2
See application file for complete search history.

(56) References Cited

U.S. PATENT DOCUMENTS 3,769,880 A * 11/1973 Mirjanic ..... F02F 1/004 123/193.2
3,792,518 A * 2/1974 Cross ..... F02F 1/00 29/888.01
4,202,310 A * 5/1980 Zorrilla ..... F02F 1/12 123/193.2
4,447,275 A * 5/1984 Hiraoka ..... F01P 11/06 123/41.72
4,495,907 A * 1/1985 Kamo ..... C23C 18/1216 123/193.2

(Continued)

FOREIGN PATENT DOCUMENTS

DE 19605946 C1 7/1997
DE 198 45 347 C1 3/2000

(Continued)

*Primary Examiner* — Hung O Nguyen
(74) *Attorney, Agent, or Firm* — Robert L. Stearns; Dickinson Wright, PLLC

(57) ABSTRACT

The present invention relates to a cylinder liner with a covering layer, and a wear-resistant inner layer, arranged inside of the cylinder liner, wherein a thickness of the wear-resistant inner layer, decreases on at least one axial end of the cylinder liner.

11 Claims, 6 Drawing Sheets

(56) References Cited

U.S. PATENT DOCUMENTS 4,757,790 A * 7/1988 Ushio ..... C22C 49/14 123/193.2
5,050,547 A * 9/1991 Takahashi ..... F02F 1/16 123/193.2
5,148,780 A * 9/1992 Urano ..... F02F 1/12 123/193.2
5,402,754 A * 4/1995 Gunnarsson ..... F02F 1/16 123/193.2
5,619,962 A * 4/1997 Ikegaya ..... C25D 7/04 123/193.2
5,806,481 A * 9/1998 Ikegaya ..... C25D 7/04 123/193.2
6,463,843 B2 * 10/2002 Pippert ..... F04B 53/166 92/170.1
6,508,240 B1 * 1/2003 Bedwell ..... F02B 75/08 123/668
7,171,935 B2 * 2/2007 Komai ..... B22D 19/0009 123/193.2
2006/0156917 A1 * 7/2006 Oda ..... F02F 1/004 92/171.1
2010/0059012 A1 * 3/2010 Tachibana ..... F02F 1/004 123/193.2
2010/0116240 A1 * 5/2010 Campbell ..... B22F 5/008 123/193.2
2012/0318228 A1 * 12/2012 Aharonov ..... C23C 16/509 123/193.2
2013/0340700 A1 * 12/2013 Donahue ..... F02F 1/004 123/193.2

FOREIGN PATENT DOCUMENTS

DE 10338386 B3 12/2004
JP S5996457 A 6/1984
JP H01155061 A * 6/1989 ..... F02F 1/004
JP H0828705 A 2/1996

* cited by examiner

CYLINDER SLEEVE WITH WEAR-RESISTANT INNER LAYER

BACKGROUND OF THE INVENTION

1. Technical Field

The present invention relates to a multilayer cylinder liner that is distortion and stress-optimized. The present invention further relates to a method for manufacturing such a cylinder liner with a wear resistant inner layer.

2. Related Art

Cylinder liners with a multilayer structure are known already from DE 19605946 C1.

Two-layer cylinder liners are also known, in which two tubes of different materials, one iron-based wear-resistant layer and one light metal-based covering layer are inserted into each other and joined to each other thermally.

A problem occurs in the known cylinder liners if the different layers of the cylinder liner have different strengths and different coefficients of thermal expansion. Under thermal load, bending stresses can occur that can lead to distortion of the cylinder liner or partial or complete detachment of the layers from each other. In particular, the stresses can lead to elastic-plastic deformation, and in the worst case to a mechanical failure of the coating. In this context, the greatest stresses occur at the axial ends of a cylinder liner. It is also known that this effect occurs to an even greater degree with thermal joining, due to the fact that the transfer of heat from the combustion chamber to a cooling plate of the engine is prevented by the constriction, and can result in an even higher temperature and even greater stress.

SUMMARY OF THE INVENTION

It is therefore desirable to be able to use a cylinder liner in which the stresses between a wear-resistant inner layer and a cover layer are minimised or eliminated entirely.

According to a first embodiment of the present invention, a cylinder liner is provided that comprises a cover layer and a wear-resistant inner layer, the inner layer is disposed inside the cylinder liner. The wear-resistant inner layer is less thick on at least one axial end of the cylinder liner, or is thinner in a certain area. Since the stresses occur mainly in the area of the ends of the cylinder liner, according to the invention the thickness of the wear-resistant inner layer is reduced at the end of the cylinder liner. Reducing the thickness of the wear-resistant inner layer also reduces a bimetallic effect at this end of the cylinder liner, because a thinner wear-resistant inner layer can only exert relatively small forces in response to changes in temperature. The wear-resistant inner layer may also end in an area from 1 to 20 mm, preferably 1 to 5 mm before at least one axial end of the cylinder liner.

The thickness of the wear-resistant inner layer may be designed to become thinner towards the end of the cylinder liner on at least one axial end of the cylinder liner. The thickness of the wear-resistant inner layer may be reduced in only a region of the end of the cylinder liner on at least at one axial end of the cylinder liner.

The issue of stress is caused by a bimetallic construction between the covering layer and the wear-resistant inner layer. Overall, the aim of the present invention is to minimise the bimetallic effects at the ends of a multilayer cylinder liner by modifying the bimetallic strip in such manner that the bimetallic effect is weakened. In the context of the present invention, this is achieved by reducing the thickness or wall thickness of one of the layers of the bimetallic strip, so that said layer may exert only relatively small forces in response to a change in temperature and thus may only create relatively low stresses.

In one exemplary embodiment, the thickness of the wear-resistant inner layer decreases at both axial ends of the cylinder liner. This embodiment makes it possible to ensure that the cylinder liner does not become constricted either at the cylinder head end or at the crankshaft end.

In a further exemplary embodiment, the thickness of the wear-resistant inner layer is reduced to zero at or before at least one axial end of the cylinder liner.

Accordingly, the thickness of the wear-resistant layer is decrease to zero at or towards the end of the cylinder liner, and this may be achieved in one step or by progressing thinning of the wear-resistant inner layer. This means that in these embodiments the end surface or surfaces of the cylinder liner consist only of the material of the covering layer.

In another exemplary embodiment, the wear-resistant inner layer ends before at least one of the axial ends of the cylinder liner. In this embodiment, the end portions of the cylinder liner (for example in the range of a few millimeters) are made only from the material of the covering layer, so that there is no bimetallic effect in this area, or the bimetallic effect between the covering layer and the wear-resistant inner layer is reduced.

In a further exemplary embodiment, the wear-resistant inner layer ends before both axial ends of the cylinder liner. With this embodiment, it may be assured that the cylinder liner cannot become warped either at the cylinder head end or at the crankshaft end.

In another exemplary embodiment, the wear-resistant inner layer ends in an area from 1 to 20 mm, preferably from 1 to 5 mm before at least one and/or both axial ends of the cylinder liner.

In still another exemplary embodiment, the thickness of the wear-resistant inner layer becomes thinner in an area from 1 to 20 mm, preferably from 1 to 5 mm before at least one and/or both axial ends of the cylinder liner.

In a further exemplary embodiment, the cylinder liner comprises at least one circumferential groove that extends around the outside and/or the inside of the cylinder liner. Such a groove may interrupt the bimetallic strip, or it may serve to make one of the layers thinner to such an extent that the bimetallic effect is significantly reduced. Greatly reduced bimetallic effect is also accompanied by significantly weaker stresses in the cylinder liner, which might otherwise cause distortions and/or deformations.

In a further exemplary embodiment, the at least one circumferential groove extends to a depth of ⅓ to ⅔ of the radial wall thickness of the covering layer or of the wear-resistant inner layer. More preferably, at least one circumferential groove extends to a depth of approximately ⅔ of the radial wall thickness of the cover layer or of the wear-resistant inner layer. Because of the reduced thickness resulting from the groove, the bimetallic effect between the covering layer and the wear-resistant inner layer is also reduced in this area.

In still another exemplary embodiment, the at least one groove (8) is located at a distance between 1 mm and 20 mm, preferably between 1 mm and 5 mm from one end of the cylinder liner (2). This arrangement enables the bimetallic effect to be drastically reduced in the critical area. There are often no longer any compression or oil scraper piston rings arranged in an area near the upper or cylinder head-end of the cylinder liner. Consequently, no adverse interactions are to be expected between the one or more grooves and any piston rings present.

In another additional exemplary embodiment, the at least one groove has a rounded cross section with a radius not exceeding 1 mm. The use of a rounded groove helps to avoid stress peaks and prevent any notch effect on the base of the groove.

In a further additional exemplary embodiment, the groove extends along a curved path inside the cylinder liner. The curvature of the path then coincides with a course of the groove in the axial direction that deviates from an ideal circular path. In one embodiment, the groove may extend in the manner of a sine wave on the inside of the cylinder liner. If the amplitude of a sine wave or a curved path is greater than the width of the groove, this will prevent a piston ring or part of an oil scraper ring from engaging in the groove.

In another exemplary embodiment, the wear-resistant inner layer terminates in a curved line in front of the axial end of the cylinder liner. The curvature of the line then coincides with the course of the line in the axial direction that deviates from an ideal circular path. In one embodiment, the line may conform to the shape of a piston skirt. This embodiment can be combined with the grooves. This embodiment can also be combined with longitudinal grooves that extend in the axial direction and substantially only in the amplitude range of the curved line.

In a further exemplary embodiment of the cylinder liner, an outer layer is also applied that counteracts the stresses between the covering layer and the wear-resistant inner layer. In this embodiment, the bimetallic effect between the wear-resistant inner layer and the covering layer is neutralised by a bimetallic effect between the wear-resistant inner layer and the covering layer in the opposite direction. In this way, it is also possible to apply the inner layer only partially in the circumferential direction.

According to a further aspect of the present invention, an engine block having at least one cast-in cylinder liner as described above is provided. In such an engine block, the known problems such as distortion of the cylinder liners do not occur, either during manufacture or operation of the engine.

According to a further aspect of the present invention, an engine having an engine block as described above is provided.

THE DRAWINGS

In the following, the present invention will be described with reference to schematic drawings.

DETAILED DESCRIPTION

Figure 1:
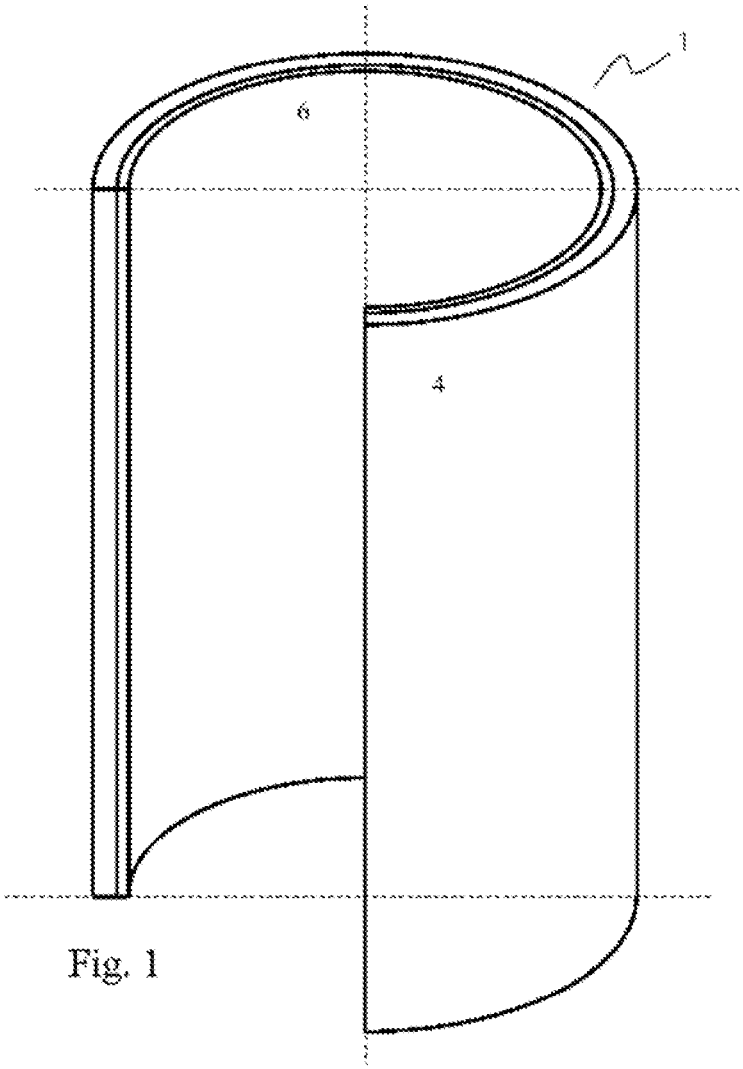
FIG. 1 is a perspective partial cross-sectional view of a two-coating or two-layer cylinder liner according to the invention.

The same reference numerals are used for identical or similar components or features both in the figures and in the drawings.

FIG. 1 is a perspective, partial cross-sectional view of a two-layer cylinder liner according to the prior art. Cylinder liner 1 the prior art includes a wear-resistant inner layer 6 and a covering layer 4 of a different material. The figure makes it evident that the cylinder liner is equivalent to a bimetallic strip that is rolled into a tube and joined by welding. It follows that when temperature changes give rise to stresses in the cylinder liner. These stresses are particularly strong at the top end (or cylinder head end) and the bottom end (also the crankshaft end) of the cylinder liner. In the middle area, these forces do not have such a pronounced effect, as they can be counteracted by the respective forces in adjacent areas.

With strong heating, the ends of the cylinder liner undergo barrel-like deformation because the inner, more wear-resistant material has greater strength and thus probably also a lower coefficient of thermal expansion. Thus, the problems described in the introduction may occur in this liner, which can lead to failure of the cylinder liner, the cylinder, and consequently of the entire engine.

Figure 2:
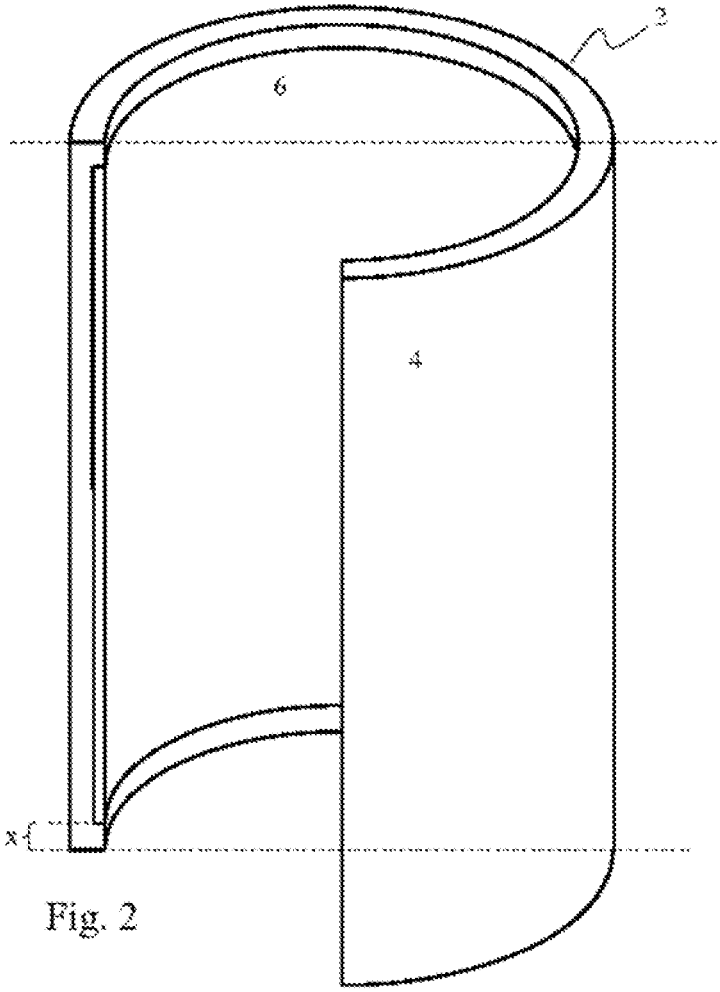
FIG. 2 represents a two-layer cylinder liner according to the invention, in which the wear-resistant inner layer ends before the axial ends of the cylinder liner.

FIG. 2 represents two-layer cylinder liner 2 according to the invention, of which the wear-resistant inner layer 6 stops before the axial ends of said cylinder liner 2. In this case, covering layer 4 extends beyond the wear-resistant inner layer 6 by distance x on both sides. Only the lower protrusion is marked in the drawing, since it is clear that the protrusion not provided with a reference sign may be made larger, smaller or the same size. The top protrusion is preferably larger, because it is subject to a greater thermal load and therefore manifests a more pronounced bimetallic effect. In this embodiment, the ends of the cylinder liner are not formed by a bimetallic strip, but consist of only one material. Thus, there is no bimetal strip at the axial ends of the cylinder liner and there is also no bimetallic effect at the ends. Any deformations of the cylinder liner are absorbed by the protruding edge of covering layer 4.

Figure 3:
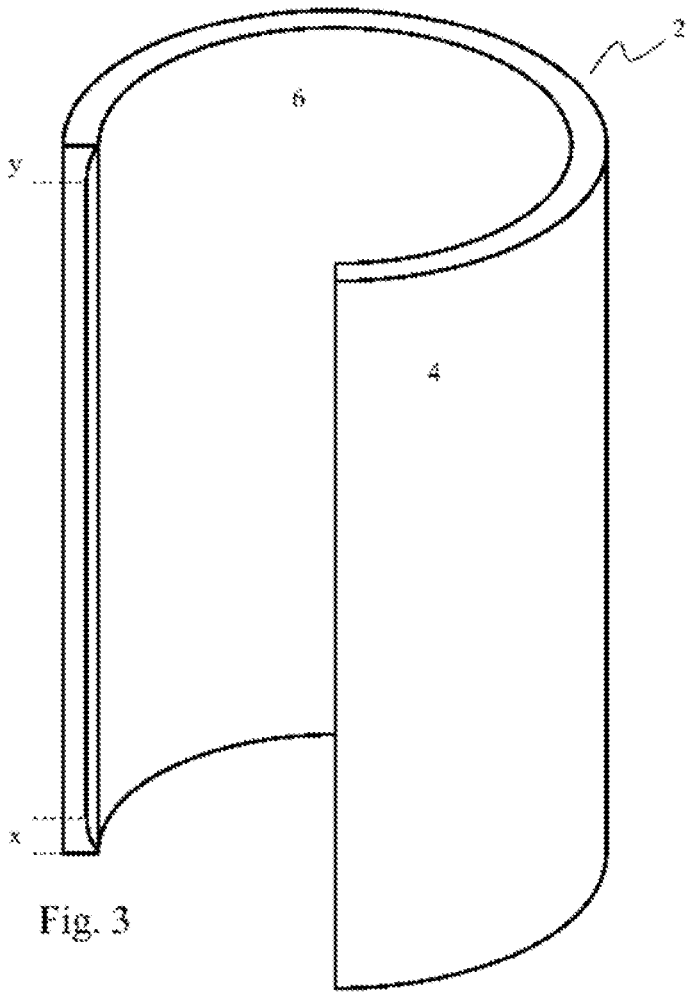
FIG. 3 represents a two-layer cylinder liner according to the invention, in which the thickness of the wear-resistant inner layer is reduced to zero on the axial ends of the cylinder liner.

FIG. 3 represents a further two-layer cylinder liner 2 according to the invention, in which the thickness of a wear-resistant inner layer 6 is attenuated to zero at the axial ends of cylinder liner 2. With this construction, the bimetallic effect is not reduced to zero at a corner or ridge, but instead gradually in a transition area x and y. This design requires a higher degree of manufacturing accuracy. IN this context, the type and width x and y of the transition may be adapted to the specific conditions prevailing in a given engine. Type and width y of upper transition region may differ from the type and width of lower transition region x.

Figure 4:
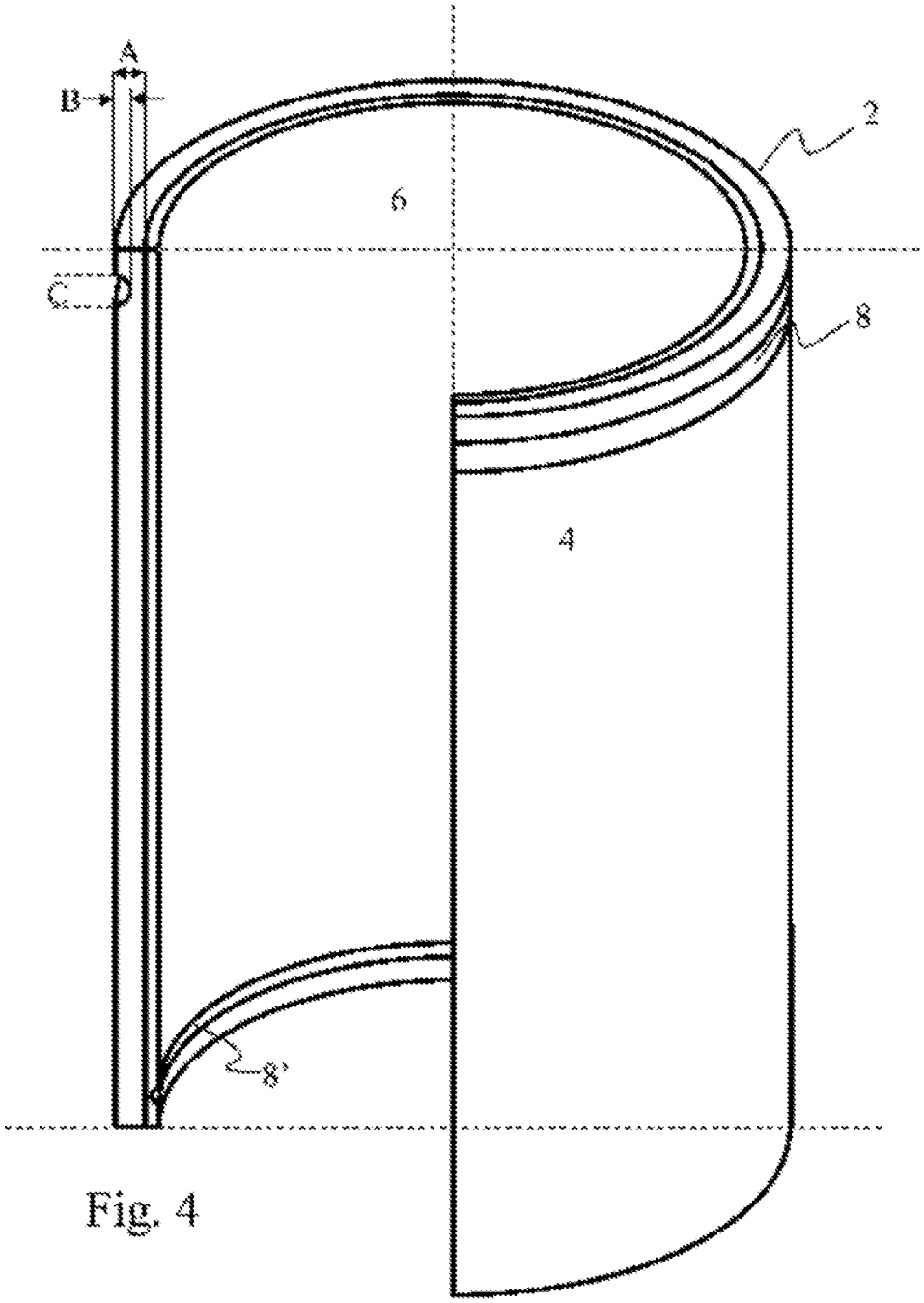
FIG. 4 represents a two-layer cylinder liner according to the invention, in which the thickness of a wear-resistant inner layer is reduced by a groove in the region of an axial end of the cylinder liner.

FIG. 4 represents a two-layered cylinder liner according to the invention, in which the thickness of a wear-resistant inner layer is reduced in the area of an axial end of the cylinder liner by a groove. In this embodiment, the cylinder liner is furnished with an inner groove 8' and an outer groove 8. Both grooves 8, 8' reduce the thickness of each layer of material compared with the thickness of the respective other layer. The grooves have the effect of weakening the cross section of the respective layer according to the depth of the groove 8, 8', which in turn reduces the bimetallic effect. In FIG. 4, internal groove 8' is applied to the bottom of the cylinder liner, so that groove 8' cannot come into conflict with piston rings. To avoid conflict with the piston rings that might engage in the groove, upper groove 8 created on the outside of the cylinder liner.

Figure 5:
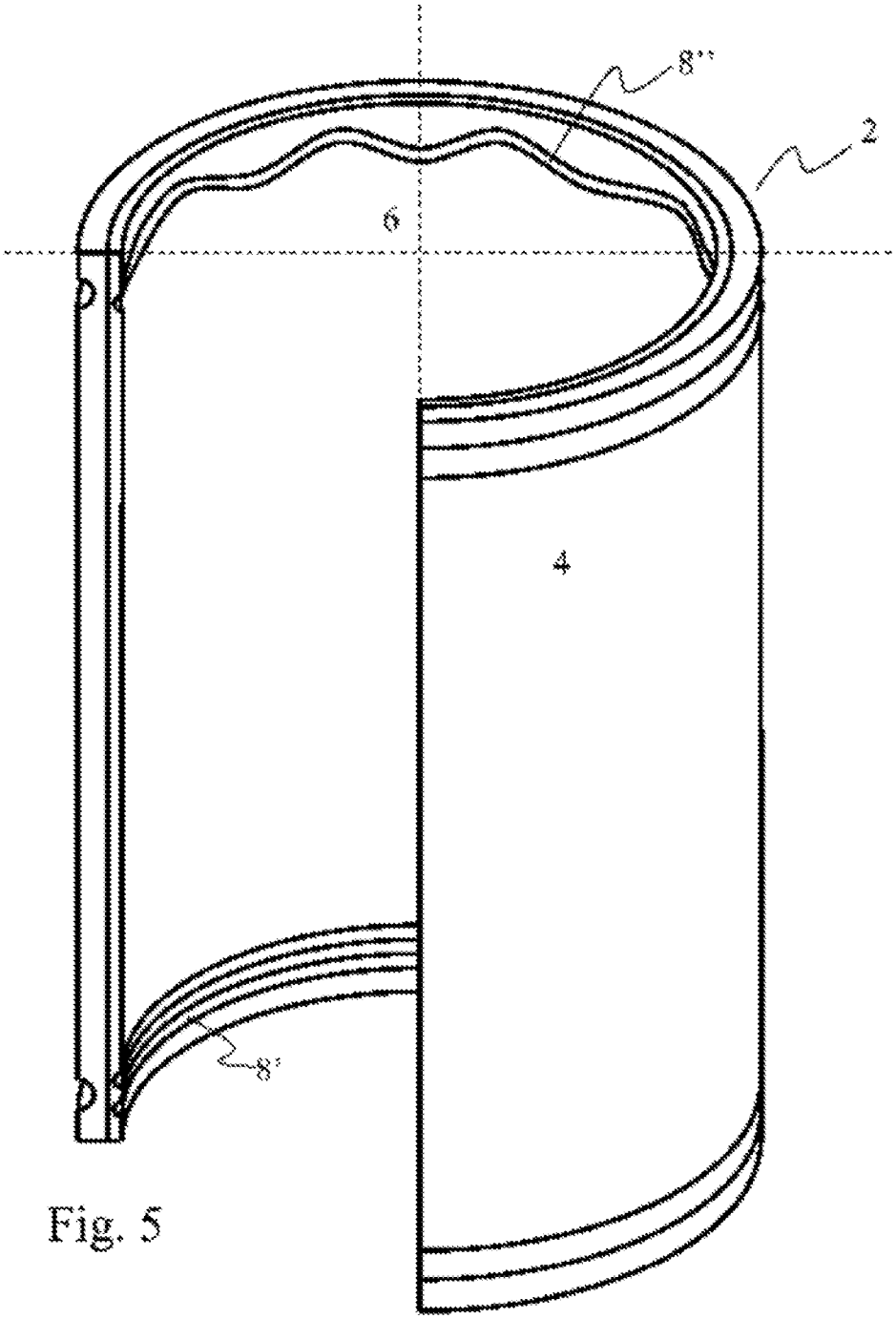
FIG. 5 represents two-layer cylinder liner according to the invention, with a plurality of grooves.

FIG. 5 represents an inventive two-layer cylinder liner with a plurality of grooves.

FIG. 5 represents an inventive two-layer cylinder liner in which the thickness of a wear-resistant inner layer is attenuated in the region of an axial end of the cylinder liner by grooves 8', 8". In this embodiment, the cylinder liner is furnished with two inner grooves 8' at the bottom. In addition, the cylinder liner comprises two outer grooves 8, each having an upper and a lower outer groove.

Cylinder liner 2 is also furnished with an upper inner groove 8", which extends in a wavy line or along a curved path on the inner surface of the cylinder liner. Consequently, a piston ring that might fit into the groove when the piston is fitted in the cylinder is no longer able to do so, and so does not constitute a hindrance to installation. It is also possible to arrange an interrupted groove on the lower or upper end of the cylinder liner, to avoid any problems with piston rings. The compression rings are not seated at the top of a piston, so if the groove is arranged at a sufficiently short distance from the top of the cylinder liner, it will not come into contact with the compression rings.

It should be noted that the grooves can also be used at one or both ends of a cylinder liner, as shown in FIGS. 2 and 3.

The lower inner and outer grooves 8, 8' can significantly reduce the bimetallic effect, and therewith also the stresses voltages at the lower end of the cylinder liner.

Figure 6:
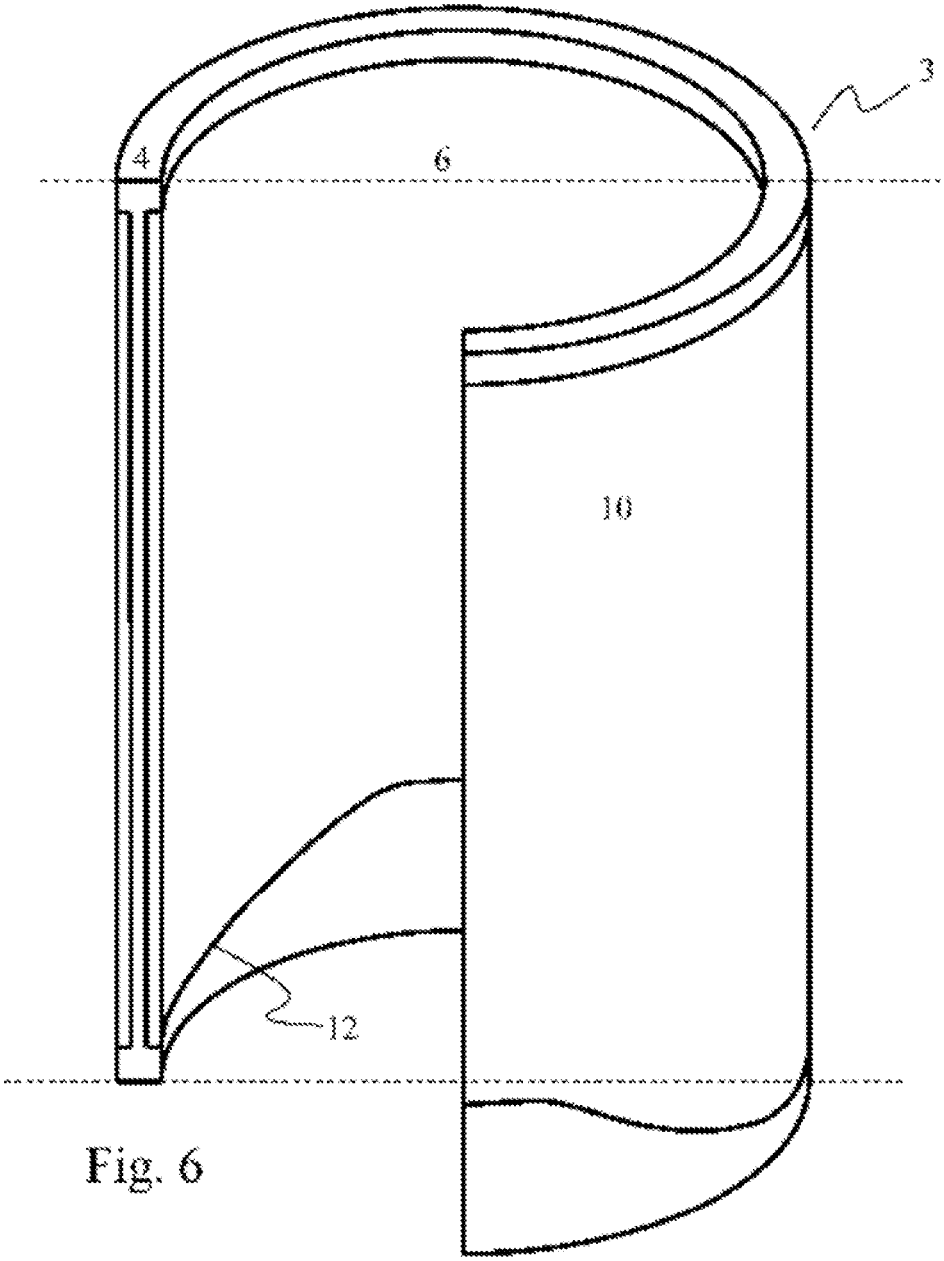
FIG. 6 represents a three-layered cylinder liner according to the invention, wherein the inner and the outer layers end before the bottom end of the of the cylinder liner in the drawing.

FIG. 6 represents a three-layer cylinder liner 3 according to the invention, in which the inner and outer layers end before the bottom end of cylinder liner 3 as shown in the drawing. Wear-resistant inner layer 6 is only partially realised in the circumferential direction in FIG. 6. Modern pistons with only a partial piston skirt only require a wear-resistant inner layer 6 in the sections shown. In a two-layer cylinder liner, rotationally symmetrical deformation be created not only at the lower end due to the thermal stresses of the bimetallic effect. In addition, under the effect of the heat, the lower oval is deformed by the non-rotationally symmetrical stresses. In the embodiment shown, an outer layer 10 is also applied on top of covering layer 6. Outer layer 10 is dimensioned (material thickness, strength, coefficient of thermal expansion) is such manner as to cancel out the thermal stresses. Such stress compensation can only work if the wear-resistant inner layer 4 and outer layer 10 each cover the same areas.

It should be evident that all layer profiles in the axial direction and in the circumferential direction may be combined at will, and a further combination with grooves 8, 8' and 8" is equally possible. These are not shown simply for the sake of clarity.

A process for producing a multilayer distortion and stress-optimized cylinder liner for fitting or casting into, a cylinder crankcase made from iron or light metal is also provided.

A cylinder liner having at least one wear-resistant layer (6) on the inner diameter and one covering layer (4) on the outer diameter thereof is manufactured such that the thickness of the wear-resistant layer (6) is attenuated to zero towards the axial end of the cylinder liner (see FIGS. 2 and 3). All cylinder liners represented in the drawings can be produced according to a known method, for example by means of thermal spraying, in which the axial expansion of wear protection layer (6) is less than the axial expansion of covering layer (2). This may be achieved for example by varying the travel of the spray gun, or using appropriate covers or masks. The axial length of the part of the cylinder liner produced without a wear protection layer at one end or both ends (dimensions x and y) is from 1 to 20 mm, ideally 1 to 5 mm.

It is also envisaged to use a combination method in which a wear-resistant inner layer treated in a mechanical or thermal processing method is furnished with an outer layer by thermal spraying. It is also possible to provide a wear-resistant inner layer 6 with a covering layer by encapsulation.

Depending on its design, a liner produced in this way may be used for thermal joining, force fitting or casting into the engine block. Alternatively, or in addition to the attenuation of the wear-resistant layer to zero, one or more circumferential grooves (8, 8', 8") may be created in the outer or inner surface of the liner (see 4 and 5) to reduce the stresses. The location, shape and depth of the groove may be varied according to the expected stress states in the cylinder liner. An inner groove having a depth of approximately ⅔ of the radial wall thickness, and radius of up to 1 mm with an axial clearance of 1 to 20 mm from the end face is currently considered ideal for motor vehicle engines. However, other dimensions, depths and groove shapes may also be used. The grooves may be created in the surfaces both by cutting and thermal processing methods. Particularly when laser engraving techniques are applied, curved or wavy grooves are very expedient forms. Furthermore, laser engraving techniques may also be used to create interrupted grooves or dot patterns to reduce the wall thickness of the wear-resistant inner layer 4.

The invention claimed is:

1. A cylinder liner, comprising:

a covering layer and a wear resistant inner layer that is disposed inside the cylinder liner, wherein at least one end of the wear-resistant inner layer presents a line located in an area from 1 to 20 mm before an axial end of the cylinder liner, and wherein the line is curved in two-dimensions and extends in the circumferential direction around the cylinder liner, and the wear-resistant inner layer is located around only a portion of the circumference of the cylinder liner.

2. The cylinder liner according to claim 1, wherein a thickness of the wear-resistant inner layer decreases at both axial ends of the cylinder liner.

3. The cylinder liner according to claim 1, wherein the thickness of the wear-resistant inner layer decreases to zero at or before at both axial ends of the cylinder liner.

4. The cylinder liner according to claim 1, wherein the wear-resistant inner layer ends before both axial ends of the cylinder liner.

5. The cylinder liner according to claim 1, wherein the cylinder liner comprises at least one circumferential groove arranged on the outside and/or inside of the cylinder liner.

6. The cylinder liner according to claim 5, wherein the at least one groove extends to a depth of ⅓ to ⅔ of the radial wall thickness of the covering layer, or the wear-resistant inner layer, and/or wherein the at least one groove is arranged at a distance between 1 mm and 20 mm from one end of the cylinder liner, and/or wherein the at least one groove has a rounded cross section radius not exceeding 1 mm.

7. The cylinder liner according to claim 5, wherein the groove extends in a curved path inside the cylinder liner.

8. The cylinder liner according to claim 1, further comprising an outer layer that neutralizes the tensions between the covering layer and the wear-resistant inner layer.

9. An engine block having at least one cast-in cylinder liner according to any one of the preceding claims.

10. A engine comprising an engine block according to claim 9.

11. The cylinder liner of claim 1, wherein at least one of the ends of the wear-resistant inner layer is from 1 to 5 mm before the axial end of the cylinder liner.

* * * * *